United States Patent [19]

Kapetanakos et al.

[11] 4,126,806

[45] Nov. 21, 1978

[54] INTENSE ION BEAM PRODUCING REFLEX TRIODE

[75] Inventors: Christos A. Kapetanakos, Bethesda; Jeffry Golden, Laurel, both of Md.

[73] Assignee: The United States of America as represented by the Secretary of the Navy, Washington, D.C.

[21] Appl. No.: 836,822

[22] Filed: Sep. 26, 1977

[51] Int. Cl.[2] ..... H01J 23/08; H01J 27/00; H05H 1/00

[52] U.S. Cl. ..... 313/155; 250/423 R; 313/230; 313/359

[58] Field of Search ..... 313/155, 230, 153, 359, 313/231.3; 250/423 R; 315/111.8

[56] References Cited

U.S. PATENT DOCUMENTS 4,045,677 8/1977 Humphries, Jr. et al. ..... 250/423 R

*Primary Examiner*—Palmer C. Demeo
*Attorney, Agent, or Firm*—R. S. Sciascia; Philip Schneider; David G. Rasmussen

[57] ABSTRACT

A reflex triode for use in producing ultra-high-current ($>10^5$A), ultra-high-power ($>10^{11}$W) ion beams includes an improved anode and an improved cathode and has a low inductance design. A cylindrical anode stalk supporting the anode is positioned inside of and closely spaced from a cylindrical cathode shank which supports the cathode. Magnetic insulation allows for a close spacing between the anode stalk and cathode shank which reduces the inductance. The improved cathode is embedded in a cathode mount to reduce divergence of the ion beam. The improved anode consists of conducting concentric rings with thin film in the space between the rings to produce a more uniformly dense ion beam having low divergence.

9 Claims, 8 Drawing Figures

INTENSE ION BEAM PRODUCING REFLEX TRIODE

BACKGROUND OF THE INVENTION

1. Field of the Invention

The invention relates to a reflex triode for use in producing ultra-high-current ($>10^5$A), ultra-high-power ($\geqq 10^{11}$W) ion beams.

2. Description of the Prior Art

An ion beam producing reflex triode (shown in FIG. 1) is a device consisting of an electron emitting cathode and an anode which is a thin film that is semi-transparent to electrons. The anode is at high positive potential relative to the cathode during an applied electrical pulse. Electrons emitted from the cathode are accelerated toward the anode, pass through it and form a virtual cathode. The anode is located between the two cathodes. As a consequence of the energy dissipated at the anode and elastic scattering which reduces the electron axial velocity, the electrons perform damped axial oscillations. The ions are extracted out of the plasma formed from the anode film by the oscillating electrons and by surface flashover. Some ions are accelerated toward the real cathode and some are accelerated toward the virtual cathode. The ions that are accelerated toward the virtual cathode pass through it and form a drifting beam that is current-and space-charge-neutralized.

Humphries, Lee and Sudan (Applied Physics Letter 25, p. 20, 1974) were the first to report results on the production of ion beams using reflex trioxides. In their first reported attempt, the anode of the reflex triode was constructed of parallel copper wires coated with varnish. Because the varnished wires provided meager plasma, only weak ion beams were obtained (i.e., about 250 A (one side) ion current having energy of about 100 keV). In their second attempt, Humphries, Lee and Sudan replaced the parallel copper wires with nylon filaments. The difficulty with this approach, as with the previous one, is that the plasma is produced only near the plastic filaments. As a consequence of this fact, the ion-current density is low and the beam is non-uniform or badly divergent. These difficulties with non-uniformity are further exacerbated by operating the device in high axial magnetic fields which constrain the transverse excursions of the electrons. A more important limitation of this configuration is the absence of inelastic energy loss and elastic scattering by the oscillating electrons at the anode. This loss of energy and the reduction of axial velocity which results from elastic scattering is important because after the electron passes through the anode it cannot pass through as large a potential difference toward the virtual or real cathode as prior to that transmited through the anode. The result of the axial velocity loss is a piling up of electron space charge near the anode which results in an enhanced ion-beam production.

High voltage (megavolt) operation of an ion-beam producing reflex triode was attempted by S. Humphries, Sudan and Condit (Applied Physics Letter 26, p. 667, 1975). Using an anode made of either aluminum foil, mylar film, or nylon mesh, only weak ion beams were produced. Although the 1.8 MV, 30Ω pulse generator theoretically could produce 60 kA cathode current with a proton current as large as 30 kA, the maximum ion current produced by the reflex triode appeared to be either 2.5 kA of protons or 5 kA of aluminum ions. In this experiment the triode presented the enormous load inductance of 1.4 μH to the pulse generator. Most of the energy delivered to the reflex triode by the pulse generator went into inductive magnetic field generation and not into the ion and electron flows of the triode which constitute the resistive load of the device.

The previous experiments above point out four of the most serious deficiencies of prior art reflex triodes. The first deficiency is with the design of the anode and its inability to produce a uniformly adequate anode plasma which is necessary for a uniform beam. The second problem deals with the high inductance of the reflex triode and the resultant loss in electrical efficiency owing to energy being spent in inductive magnetic fields. The third deficiency is in the anode design which does not lead to axial velocity reduction with each pass while still permitting a large number of electron transits through the anode; thus, the ratio of ion current (one way) to "real-cathode" current is much less than 0.5. The fourth problem is that the anodes and cathodes of prior-art triodes have not been configured to provide a uniform axial electric field and well-defined virtual cathode; thus, they produced beams with large divergence.

The first and third deficiencies noted above were partially resolved by the use of an anode consisting of a polyethylene film interwoven among parallel thin copper wires (0.75 mm diameter). The use of this anode is described in J. Golden, C. A. Kapetanakos, Proc. of the 1st International Topical Conference on Electron Beam Research and Technology, Vol. I, Albq. N.M. Nov. 3–5, 1975, p. 635, and in C. A. Kapetanakos, J. Golden, W. M. Black, Phys. Review Lett. 37, 1236, 1976. This anode had two serious drawbacks. First the thin wires were not capable of withstanding the energy deposition of the reflexing electron for 1 MV, $2\times10^{10}$W, 0.2 kA/cm$^2$ ion beam operating levels. Second, the wires whose purpose was to help define the anode equipotential surface and turn on the cathode electron emission had the deleterious effect of limiting the number of electron transits through the anode.

Several aspects of the first three deficiencies were also resolved in experiments by D. S. Prono, J. M. Creedon, I. Smith, and N. Bergstrom (J. Applied Phys. vol. 46, p. 3310, 1975) and by D. S. Prono, J. W. Shearer, and R. J. Briggs (Phy. Rev. Lett. v. 37, p. 21, 1976). In their studies a large negative voltage pulse was applied to the cathode. The anode was a thin metallic or polymer film which was connected to a grounded conducting vacuum chamber. Although this prior art did have a low inductance design, the configuration had the serious limitation that the chamber was at the same potential at which the ions originate in the anode plasma so that ions would decelerate when approaching near the chamber walls thus making beam extraction difficult. Moreover, for successful operation, it was necessary to use a tenuous neutral background gas filling to obtain an adequate virtual cathode. In practice the device operated at very low impedances and with inefficient coupling to the pulse generator.

SUMMARY OF THE INVENTION

The present invention is a reflex triode which has an improved anode and cathode and a low inductance design. The reflex triode is enclosed by a conducting grounded chamber in which vacuum is maintained and which is connected to a pulse generator. The chamber walls are thin enough to allow an externally applied magnetic field to penetrate. Inside this chamber is a cylindrical cathode which is made of a conducting material which will emit electrons quickly when an electric field is applied. The cathode is supported by a cathode shank which is made of a conducting material and is cylindrically shaped. The cathode shank is grounded. Inside the cathode shank is a cylindrical anode stalk which is closely spaced to the cathode shank and is typically coaxial and concentric. One end of the anode stalk connected to the pulse generator and the other end supports the anode. The anode is made up of a pair of concentric rings of different radii, one located inside the other in the same plane perpendicular to the cylindrical axis of the anode stalk and with polyethylene film supported in the space between the rings. The anode faces the cathode and is spaced from it. A plasma is formed at the polyethylene film and serves as a source of ions. A magnetic field is generated between the cathode shank and anode stalk in one of two ways: (1) the anode current may be made high enough to generate a self-magnetic field; or (2) a solenoidal electromagnet may be placed around the chamber walls to generate the magnetic field.

A novel feature of the above apparatus is the anode. The construction of the anode having two, spaced, rings with the polyethylene film supported in the space between constitutes an anode on which plasma is rapidly and uniformly produced and which permits the electrons to make many transits through the anode while scattering and losing energy each pass so as to cause the electron space charge to pile up near the anode.

Another novel feature is the use of magnetic insulation in conjunction with the close spacing of the anode stalk and cathode shank. The magnetic field which provides electrical insulation may be produced by external electromagnet or by a sufficiently large current in the anode. Magnetic insulation permits the close spacing which results in the low inductance of the reflex triode, while preventing arcing and loss of energy due to electron emission and currents between the anode stalk and cathode shank.

An additional novel feature is the embedding of the cathode into a cathode mount which improves the uniformity of the electric field in the anode-cathode gap resulting in a better virtual cathode and a lower-divergence ion beam.

BRIEF DESCRIPTION OF THE PREFERRED EMBODIMENT

Figure 1:
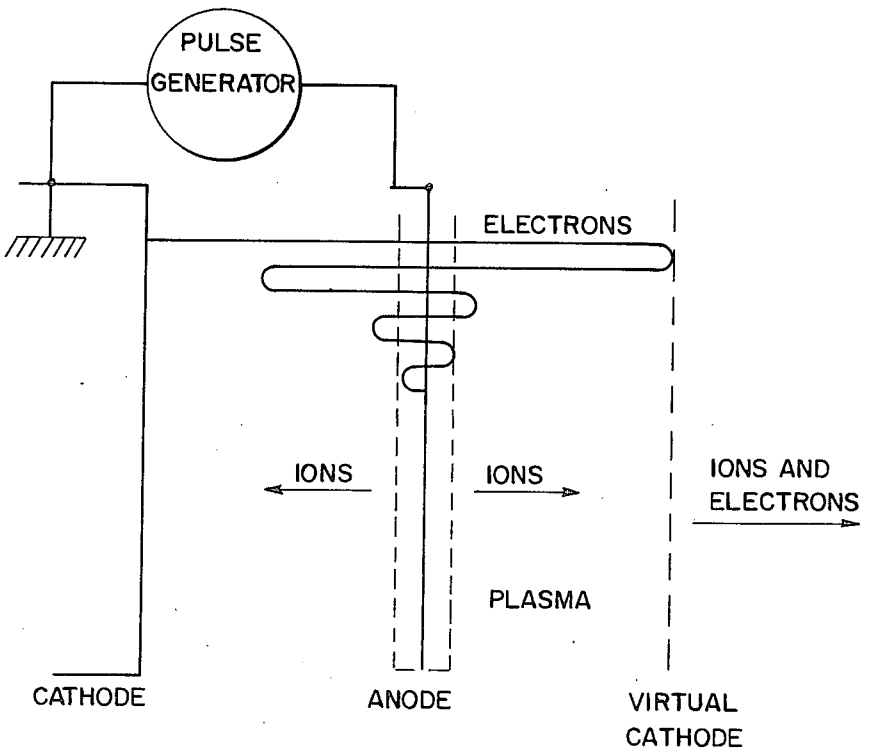
FIG. 1 (PRIOR ART)
FIG. 1 is a diagrammatic view showing the principle of operation of a prior-art reflex triode.

FIG. 1 shows the principle of operation of the prior art reflex triodes described previously.

Figure 2:
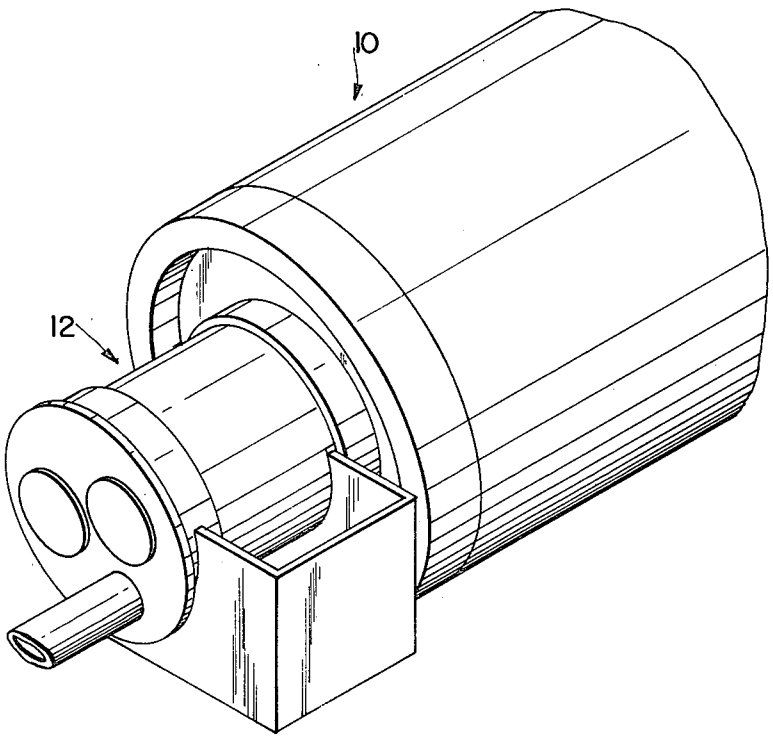
FIG. 2 is a perspective view of an ultra-high-power pulse generator connected to the improved ion-beam reflex triode of the invention.

FIG. 2 shows an outside perspective view of a prior-art, low impedance, ultra-high-power pulse generator 10 connected to the improved reflex triode 12 of the invention. Pulse generator 10 provides half-terawatt pulses for use in reflex triode 12 which produces an intense, pulsed ion beam. Pulse generator 10 has a characteristic output impedance of 1.5 ohms, and produces positive pulses above 1.0 MV and lasting 70 nsec with a power of 0.75 TW and more than 50 kJ energy when delivered to a low-inductance matched load. The measured output inductance of pulse generator 10 and reflex triode 12 is about 48 nH with about 36 nH owing to the output configuration of the pulse generator and 12 nH due to the reflex triode. In general, reflex triode 12 is designed to have a minimum of inductance and an impedance that is nearly matched to the characteristic impedance of pulse generator 10. This maximizes the energy delivered from pulse generator 10 to the charge particle motion in reflex triode 12 and minimizes the energy diverted into inductive magnetic fields.

Figure 3:
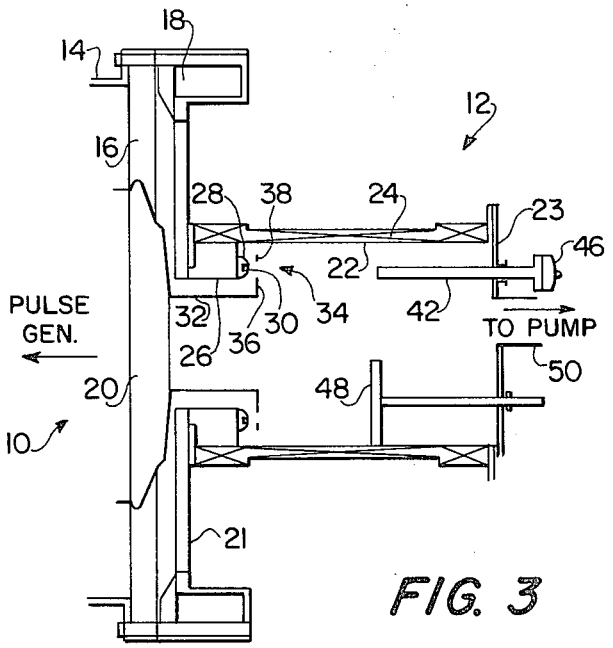
FIG. 3 is a sectional view of the reflex triode of FIG. 2.

FIG. 3 shows a sectional view of reflex triode 12 attached to pulse generator 10. The output portion of pulse generator 10 has a cylindrical housing 14 to which is connected a concentric dielectric insulating plate 16. Enclosing the end of pulse generator 10 is a pump manifold 18 which is part of a system for creating a vacuum in pulse generator 10 and reflex triode 12. The output terminal of pulse generator 10 is a stainless steel hub 20 which extends through insulating plate 16 and is accessible axially through the annulus of pump manifold 18.

Reflex triode 12 is enclosed by a stainless steel chamber 22, an aluminum "door" flange 21 which is sealed against pump manifold 18 to maintain a vacuum, and end plate 23. Surrounding chamber 22 are solenoidal electromagnet windings 24 which are varied in number along the length of chamber 22, being increased in number per unit length at both ends to maintain a uniform magnetic field (i.e., magnetic insulation) inside chamber 22. Although stainless steel is the preferable material for chamber 22, any conducting material which is thin enough for penetration by an external magnetic field may be used.

Inside of chamber 22 is a cylindrical cathode shank 26. The definition of cylinder need not be a right circular cylinder but may be any continuous surface, for example, an ellipse. However, a right circular cylinder is the preferred embodiment. Cathode shank 26 is made of electrically conducting material but is thin enough so that the applied magnetic field from electromagnet windings 24 can penetrate into the gap between cathode shank 26 and anode stalk 32. In an alternative embodiment of the invention, described subsequently, magnetic insulation is provided by the current in the anode stalk. In this case, the cathode shank must be thick enough to prevent penetration of the magnetic field owing to the current in anode stalk 32 during the duration of the pulse. Cathode shank 26 is anchored and grounded at one end to the "door" flange 21 which connects to pump manifold 18 while the other end supports a cathode mount 28. Cathode mount 28 is preferably made of a stainless steel half ring which has the same cylindrical shape as cathode shank 26 (preferably circular) and mounts on the top of it. The word ring used herein is not limited to being round but for example may be elliptical. It is also preferable that cathode mount 28 make electric contact at its outer circumference with chamber 22. Embedded in the center of cathode mount 28 is a cathode 30 made preferably of carbon. Cathode 30 has the ring shape of cathode mount 28 and is flush with its surface.

Although cathode 30 is preferably made of carbon, it may be made of any field emission cathode material, for example, brass, aluminum or conducting plastic. Cathode mount 28 must be made of a conducting material which does not emit as well as the cathode material during the duration of the pulse. For example, if the cathode is made of carbon, the cathode mount preferably may be made of stainless steel or titanium. For a pulse of duration $\tau$, the materials are to be chosen such that for a given electric field (resulting from the applied potential pulse) the cathode rapidly becomes an electron emitter during the pulse while the cathode mount emits very little.

Inside of cathode shank 26 is a cylindrical anode stalk 32. The cylinder need not be but is, preferably, a right circular cylinder. Anode stalk 32 is electrically connected to stainless steel hub 20 of pulse generator 10 at one end and supports anode 34 at the other end. Anode stalk 32 is preferably made of stainless steel. Anode 34 has a support made preferably of a pair of concentric rings 36, 38 lying in the same plane which is perpendicular to the cylindrical axis, one ring being inside the other and spaced from it. Stainless steel spokes hold rings 36, 38 apart. The anode is shaped so that the spacing between rings 36, 38 is slightly greater than the annular thickness of cathode 30 and directly opposite the cathode (preferably the cathode and anode are both circular). A sheet of 12.4 μm thick polyethylene film 27 (see FIG. 8) is supported in the space between rings 36, 38 (i.e., opposite the cathode) by being interwoven among the spokes 29 or for axially thin spokes, attached to the cathode side of the spokes with adhesive.

Devices used for test purposes only and not necessary as components in the normal operation of a reflex triode are scintillator 42 with attached photodiode 46 and nuclear activation target 48.

Scintillator 42 extends through an endplate 23. Scintillator 42 has photodiode 46 attached which will convert light pulses received via a light pipe from the scintillator (indicating a particle has been detected) into electrical pulses. Nuclear activation target 48 made preferably of carbon or boron nitride (BN) also extends through endplate 23. Target 48 is used to detect the number of ions generated by reflex triode 12. Testing by scintillator 42 with photodiode 46 and by nuclear activation target 48 are described in the reference (F. C. Young, J. Golden, C. A. Kapetanakos, Review of Scientific Instruments, Vol. 48, p. 432, 1977). A passage 50 in endplate 23 leads to vacuum pumps (not shown).

Figure 4:
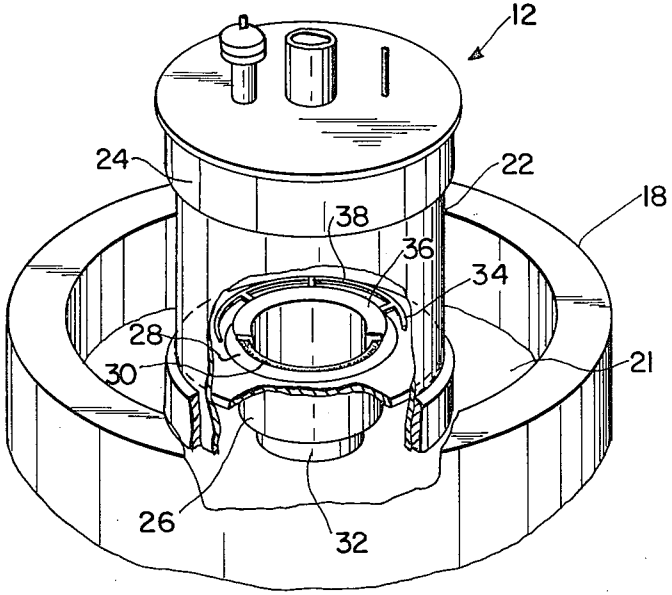
FIG. 4 is a partially cut away perspective view of the reflex triode of FIG. 3.

FIG. 4 shows a partially cut away, perspective view of the reflex triode mounted on pulse generator 10. Pump manifold 18 is shown surrounding reflex triode 12. Chamber 22 (with external electromagnet windings 24 integral therein) is cut away to expose the area around cathode shank 26, cathode mount 28, cathode 30, anode stalk 32, and anode 34. Cathode shank 26 is shown surrounding anode stalk 32. Anode 34 contains rings 36, 38 and is partially cut away to expose cathode mount 28 and cathode 30.

Figure 5:
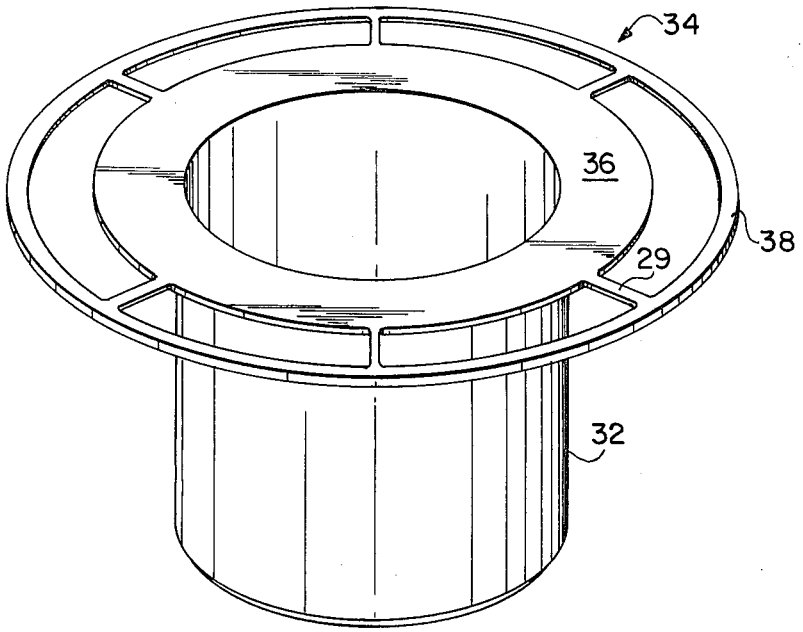
FIG. 5 is a perspective view of the anode used in the reflex triode of FIG. 3.

FIG. 5 shows a perspective view of anode 34 shown in FIG. 3. Anode stalk 32 is a stainless steel right circular cylinder having an inner diameter radius of 9.5 cm and a wall thickness of 1.5 mm, and an axial length of 20 cm. At the top are stainless steel rings 36, 38 which each have an axial thickness of 2.4 mm and are spaced about 3 cm apart. Ring 36 is integrally attached to anode stalk 32 and supports outer ring 38 by six radial spokes of 0.64 cm azimuth thickness. The 12.5 μm thick polyethylene film is woven among the spokes in the area between rings 36, 38 or attached to the cathode 30 side of the spokes by adhesive. New polyethylene film must be inserted for each experiment.

Figure 6:
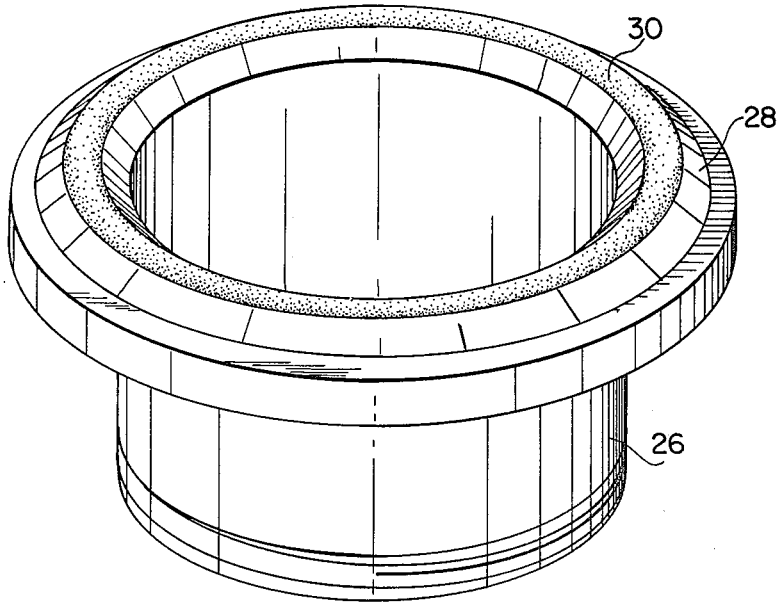
FIG. 6 is a perspective view of the cathode used in the reflex triode of FIG. 3.

FIG. 6 shows a perspective view of cathode 30, cathode mount 28, and cathode shank 26 of FIG. 3. Cathode shank 26 is a stainless steel cylinder having an inner radius of 12.7 cm and a wall thickness of 3 mm. Cathode mount 28, which is a stainless steel half-ring having an inner radius of 12.7 cm and an outer radius of 18.4 cm, is mounted on top of cathode shank 26. Cathode 30 has a 1.9 cm width and a 15.1 cm inner radius. It is embedded in cathode mount 28 so that its surface is flush with the cathode mount. Cathode shank 26 surrounds anode stalk 32 and is spaced about 3.2 cm from it.

Figure 7:
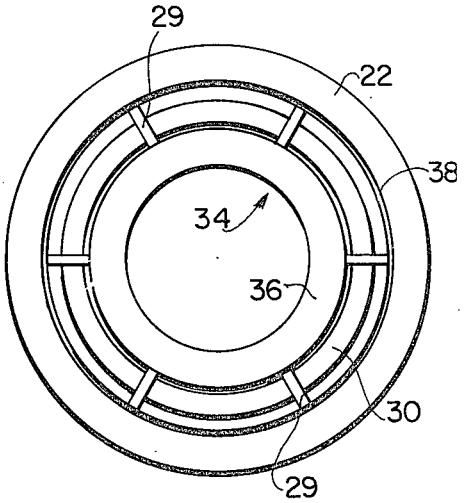
FIG. 7 is a top view along the axis of the anode and cathode of FIG. 3.

FIG. 7 shows a top view of anode 34 made up of rings 36, 38 and cathode 30 as they are assembled in reflex triode 12. The axial spacing between anode 34 and cathode 30 may be chosen to obtain a desired impedance. This spacing is determined according to known principles. An example would be adjustment of the spacing to obtain an impedance that is matched to the generator resulting in efficient energy transfer. For maximizing the pulse voltage or current other impedances would be selected. In testing, values of 1.8 cm to 2.9 cm having resulted in impedances which have been within a factor of 2 of the 1.5 ohm characteristic impedance of the generator 10.

Figure 8:
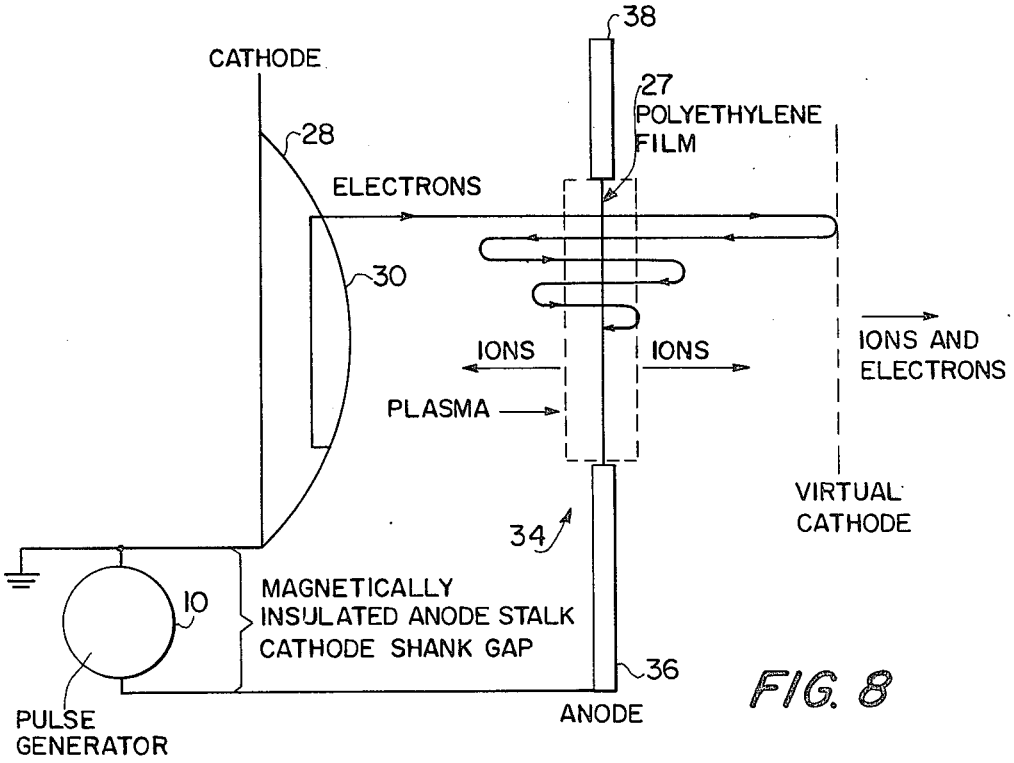
FIG. 8 is a diagrammatic view showing the principle of operation of the reflex triode of the invention.

FIG. 8 shows schematically the principle of operation of reflex triode 12. A pulse is applied from pulse generator 10 to anode 34. Electrons are accelerated toward the polyethylene film of anode 34, pass through it and form a virtual cathode. As a result of energy dissipated and elastic scattering which reduces the axial electron velocity at the anode, the electrons perform damped oscillations. As a result of the electrons passing through the anode, plasma is formed from the polyethylene. Ions are accelerated out of the plasma on each side of the anode, some of them being accelerated toward the virtual cathode and some toward the real cathode. Those ions accelerated toward the virtual cathode pass through the virtual cathode and form a drifting beam that is space-charge-and-current-neutralized. This neutralization is because of electrons dragged along by the ions as they leave the virtual cathode.

In operation, a 0.6 to 1.2 MV positive pulse of about 70 nsec duration from pulse generator 10 is applied to anode 34 of reflex triode 12. To insure that the optimum power from the pulse is transferred to the resistive portion of the load of reflex triode 12 (i.e., the portion used for generation of electron and ion flows), it is necessary to minimize the inductance of reflex triode 12. Minimizing inductance prevents the diversion of power into the inductive magnetic fields. This is accomplished by designing reflex triode 12 in such a way that the current flows in a very closely spaced cylindrical configuration. To obtain this configuration, cathode shank 26 and anode stalk 32 are in the concentric coaxial configuration shown in FIGS. 3 and 4. The spacing between the cathode shank and anode stalk in about 3 cm and results in a low inductance of about 12 nH. Since the inductance of pulse generator 10 is about 36 nH, the measured load inductance of pulse generator 10 is about 48 nH.

Since the pulse from pulse generator 10 to anode 34 is of the order of 1 MV and the spacing of cathode shank 26 and anode stalk 32 is of the order of 3 cm, electron emission and current flow would normally occur between the two. To prevent this, an external magnetic field (i.e., magnetic insulation) is applied to the spacing. The magnetic insulation is applied by external electromagnet winding 24 wrapped around chamber 22. The winding is designed to give a uniform field. The field is sufficiently strong so it suppresses current flow in the region between the anode stalk and the cathode shank. The field is chosen so that the following condition for magnetic insulation is met:

$$B \geqq 1.71 \times 10^{-3} \frac{[\gamma^2 - 1]^{\frac{1}{2}}}{d(1 + \frac{d}{2r_a})}$$

where $d = r_c - r_a$, $r_c$ is the cathode shank inner radius in meters, $r_a$ is the outer radius of the anode stalk in meters, $\gamma$ is the relativistic parameter that is equal to $1 + (eV/m_oc^2)$, B is given in $W/m^2$, V is the applied potential in volts, $e$ is the electron charge, $m_o$ is the rest mass of the electron, and $c$ is the speed of light (all in mks metric units). For the operating model, the minimum magnetic field theoretically required is 0.13 $W/m^2$. Considerable care was taken to remove sharp edges from the cathode shank. In operation, there was no evidence of physical damage to either the anode stalk or the cathode shank as a result of any field emission or current flow across the magnetic insulation.

An alternative method for generating a magnetic field in the gap between cathode shank 26 and anode stalk 32 is to eliminate windings 24 and operate the triode at lower impedance (for example, by reducing the axial anode-cathode gap) so that a larger current flows in the anode stalk 32. The increased current flow causes the generation of an azimuthal self-magnetic field which serves the same purpose as the axial magnetic field generated by winding 24. The current flow must be sufficiently large so that the azimuthal self-magnetic field, given by $B_o \approx 2 \times 10^{-7} I/r_c$, where I is the current in the anode stalk in amperes and $r_c$ is the cathode radius in meters, satisfies the condition for magnetic insulation given previously. The model was tested successfully in this mode with peak anode stalk currents as low as 200 kA.

Experiments with prior-art reflex triodes have established that the impedance of the reflex triode is dependent on the number, $\eta$, of transits through the anode made by the reflexing electrons. For the coaxial, low-inductance reflex triode described as the present invention, the number of electron anode transits, $\eta$, depends on the strength of the applied axial magnetic field, $B_z$, and the strength of the azimuthal self magnetic field, $B_\theta$, which is produced by the current flowing in the anode stalk. This dependence is the result of radial deflection of the electron trajectories by $B_\theta$ as they reflex. A radial motion in an axial magnetic field also produces azimuthal deflection of the electrons. Therefore, it is easily seen why $B_\theta$ and $B_z$ can influence the number of electron anode transits, $\eta$. In fact, when $B_z$ is not applied (i.e., $B_z = 0$), the electrons are deflected radially outward. If the cathode radius is too small for a given anode stalk current, then $B_\theta$ is too large and the result can be the deflection of most of the electrons into the outer ring 38 of the anode. In this situation, the electrons perform few anode transits and the ratio of the ion current to the cathode current $I_i/I_c$ is low. Also, as a consequence, the impedance of the reflex triode is high.

As the ratio $B_z/B_\theta$ is made larger, the electron trajectories straighten out and the number of transits, $\eta$, becomes larger. This results in larger values of $I_i/I_c$, i.e., more efficient ion production, and in lower impedances. Because $B_\theta$ varies with radial position and depends on the current flowing in the anode stalk, the impedance of the triode can be varied by the choice of cathode radius, applied $B_z$, anode film thickness, and the anode-cathode gap and cathode surface areas, the latter two both having influence on the anode stalk current. In tests run with a given cathode-anode gap, cathode radius and area, and anode film, the impedance would be varied from 5 ohms to about 1 ohm by varying the ratio of $B_z/B_\theta$ from zero to approximately one.

It should be noted that in the case when the applied axial field $B_z$ is zero and the aximuthal self-magnetic field $B_\theta$ is providing the magnetic insulation between the anode stalk and cathode shank, then the cathode radius and anode-cathode spacing must be chosen so that the radial deflection of the reflexing electrons does not result in too few a number of anode transits, $\eta$. For this, the ratio of the cathode radius, $r_c$, to anode-cathode spacing $g$, is to be large enough so that $$r_c/g \geqq \frac{I}{8500\sqrt{\gamma^2-1}}$$

where I is the anode stalk current in amperes and $\gamma$ is the relativistic energy parameter.

As shown in FIG. 8, when the pulse from pulse generator 10 is applied to anode 34, electrons emitted from cathode 30 are accelerated toward anode 34 pass through it and form a virtual cathode. The virtual cathode reflects electrons back toward the anode and, as a result of energy dissipated at the anode and reduction of axial velocity by elastic scattering, the electrons perform damped oscillation and eventually dampen out at the anode. Energy imparted to the anode by the reflexing electrons and surface flashover and currents on the anode result in the formation of plasma from the polyethylene. Ions in the plasma are accelerated toward the virtual cathode by the positive potential on the anode. The ions pass through the virtual cathode and form a drifting beam.

Once a drifting beam of ions has been formed, it is necessary to be able to count the number of ions. The preferred technique and only technique presently known that can be used with certainty and that will give reasonable accuracy is the nuclear activation technique disclosed in the F. C. Young, J. Golden, C. A. Kapetanakos article referenced previously. This technique not only gives information about the total number of ions in the beam, but also allows an unambiguous identification of the type of ions. Briefly, the activation technique consists of measuring the radioactivity induced in the target 18 by the ion beam. More specifically, in the case of proton beams (such as produced when polyethylene is used in the anode) a proton enters the carbon target 44 and decelerates to a stop, there is a small but known probability that the proton will strike a carbon atom and undergo the resonant nuclear reaction $^{12}C(p,\gamma)^{13}N(B^+)^{13}C$. This reaction is said to be resonant because the probability of the reaction occur-ring is large only for a small range of proton energy and is negligible for other proton energies. Thus, for protons striking the target with greater energy than the resonant energy, reactions may occur as the protons slow down through the resonant energy range. When a reaction occurs, a radioactive nucleus $^{13}N$ is formed which has a 10 minute half-life. Within a few seconds of the beam pulse striking the target, the target is removed from the vacuum system and placed between two 12.5 cm diameter NaI crystal detectors that face each other and are closely spaced, being separated by 2.5 cm. When a $^{13}N$ nucleus decays, a positron ($B^+$) is emitted that soon is annihilated by combination with a nearby electron. As each pair of positrons and electrons annihilate a pair of $\gamma$ rays having the rest mass energy of the electron and positron, 0.511 MeV, are given off in opposite directions. Electronic coincidence counting circuitry monitors the signals of pairs of $\gamma$ rays which strike the two NaI crystal detectors in coincidence. This indicates that the $\gamma$-rays resulted from the positron ($B^+$) annihilation and therefore correspond to an ion which struck the carbon target 44. In coincidence counting, the only $\gamma$-rays counted are those with energy between 0.45 and 0.55 MeV. Thus, other $\gamma$-rays that are present from background radioactivity and other reactions are ignored. At the higher energies the number of counts is corrected for the $^{12}C(d,n)^{13}N(B^+)^{13}C$ reaction induced by the natural isotopic abundance of deuterium in polyethylene.

The total number of ions measured by the nuclear activation technique is approximately 3–4 $\times$ $10^{16}$ per pulse (i.e., for each pulse from pulse generator 10). On the basis of the nuclear activation analysis, this represents a lower bound. From this number of ions, a peak ion current of 200 kA at 1 MeV is inferred using the time history of the ion pulse measured with the scintillator 42/photodiode 46 system. The peak output power in the ion beam was about 0.2 $\times$ $10^{12}$W. The ion beam contained approximately 6 kJ of energy.

The number of ions generated and the shape of the ion beam is optimized by several design factors of the reflex triode in additional to the use of magnetic insulation. The design of the anode by which polyethylene film is mounted in the space between rings 36, 38 is advantageous because it realizes adequate plasma formation on the anode polyethylene film and allows for a large number of electron transits through the anode as they reflex but with the necessary elastic scattering and inelastic losses which reduce axial velocity and modify the electron density distribution about the anode which results in greater production of beam ions. It has been found that the thinness of the film 27 affects the efficiency of the invention. Maximum efficiency of the device is obtained with a polyethylene film about 12.5 $\mu$m in thickness. Greater thickness decreases the number of transits of ions through the anode and film, and it is believed that this decreases the efficiency of the device. For other film materials, a thin film could have other thicknesses but would remain in the 10–20 $\mu$m range in all probability; the optimum thickness would have to be obtained by efficiency measurements.

In addition, the fact that cathode 30 is embedded in cathode mount 28 and flush with its surface and opposes the anode film and cylinders 36, 38 in such a way as to make the electric field in the anode-cathode gap more axial, produces a high quality ion beam having an angular divergence between 3°–4° . This anode-cathode arrangement also provides for rapid and uniform field emission from the cathode.

It should be understood that thin films other than polyethylene $(CH_2)_{2n}$ can be used. For example, when deuterated polyethylene films are used, $(CD_2)_{2n}$ deuteron beams are produced. It is apparent, of course, to those skilled in the art to which this invention pertains that if, for example, lithium-ion beams are desired, a lithium material would be used for the film. Polyethylene films are preferable where proton beams are desired because polyethylene is a more efficient producer of protons than polycarbonate, or Mylar (polyethylene terephthalate), or Saran (vinyl chloride-vinylidene chloride copolymer), for example, which also can be used. Actually, for producing protons, if efficiency is not a prime consideration, the use of any hydrogen-bearing material having a high number of hydrogen atoms per unit mass is possible.

The applications of the present invention include the production of intense field-reversing ion rings. As an ion source, the improved ultra-high current, ultra-high power reflex triode described herein provides an intense hollow ion beam of high quality that is suitable for the formation of strong ion rings. The use of reflex triodes for the production of rotating ion layers has been described by C. A. Kapetanakos, J. Golden, and F. C. Young, NucFus 16, 151, (1976). The use of field-reversed ion rings for plasma heating and containment has been described by K. R. Chu and C. A. Kapetanakos "Neutral Sustained Astron Reactor," Nuc Fus 15, 947, (1975). In addition, intense proton or deuterium beams can be used to induce nuclear reactions in targets and, if accelerated to high energy, could be used for the production of fissionable materials (H. H. Fleischmann, Cornell University, Report 186, 1976).

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A reflex triode receiving an electrical pulse from a pulse generator for producing an ion beam comprising:

chamber means, made of an electrically conducting material connected to said pulse generator and enclosing said reflex triode to maintain a vacuum;

cylindrical cathode means, made of an electrical conductor, for emitting electrons;

cylindrical shaped cathode shank means of electrically conducting material for supporting said cathode means, said cathode shank means positioned inside of said chamber means and being at the same potential as said chamber means;

anode means having a support made of a conducting material and a thin film means supported by said support, said thin film means, approximately facing and spaced from said cathode means, for providing a plasma as a source of ions and for causing accumulation of reflexing electrons near the anode means to provide an enhanced ion flow, said film means being supported in such a manner that substantially only the film means is placed in the path of reflexing electrons in the triode; and anode stalk means shaped cylindrically of a conducting material and positioned inside of and closely spaced from said cathode shank means so that a sufficiently low inductance results that efficient coupling of electrical energy from said pulse generator to said reflex triode occurs, said stalk means being approximately equal in axial length to said cathode shank means, one end of said anode stalk means connected to said pulse generator and the other end supporting said anode means, said anode stalk means carrying sufficient current to generate a magnetic field to prevent electron emission and electrical current flow between said anode stalk means and said cathode shank means.

2. The reflex triode of claim 1 in which said support of said anode means is a pair of ring shaped conductors of different radii, one spaced from and inside the other, with spokes, made of conducting material, spacing said ring shaped conductors apart, said thin film means mounted in the space between said ring shaped conductors.

3. The apparatus of claim 2 including a cylindrical cathode mount connected to said cathode shank means and having said cathode means embedded therein, said cathode mount made of a conducting material having less of an ability to emit electrons during said electrical pulse applied by said pulse generator than the conducting material of said cathode means.

4. A reflex triode receiving an electrical pulse from a pulse generator for producing an ion beam comprising:

chamber means, made of electrical conducting material permeable to magnetic fields, connected to said pulse generator and enclosing said reflex triode to maintain a vacuum;

cylindrical cathode means, made of a conducting material for emitting electrons;

cylindrically shaped cathode shank means of an electrically conducting material for supporting said cathode means, said cathode shank means positioned inside of said chamber means and being at the same potential as said chamber means;

anode means having a support made up of a conducting material and a thin film means supported by said support, said thin film means approximately facing and spaced from said cathode means, for providing a plasma as a source of ions and for causing accumulation of reflexing electrons near the anode to provide an enhanced ion flow, said film means being supported in such a manner that substantially only the film means is placed in the path of reflexing electrons in the triode;

cylindrical anode stalk means shaped cylindrically of a conducting material and positioned inside of and closely spaced from said cathode shank means, said stalk means being approximately equal in axial length to said cathode shank means, one end of said anode stalk means connected to said pulse generator and the other end supporting said anode means;

electromagnet winding means cooperating with said chamber means for providing a uniform magnetic field between said anode stalk means and said cathode shank to prevent electron emission and electrical current flow between said anode stalk means and said cathode shank means.

5. The reflex triode of claim 4 in which said support of said anode means is a pair of ring shaped conductors of different radii, one spaced from and inside the other, with spokes made of conducting material spacing said ring shaped conductors apart, said thin film means mounted in the space between said ring shaped conductors.

6. The apparatus of claim 4 including a cylindrical cathode mount connected to said cathode shank means and having said cylindrical cathode means embedded therein, said cylindrical cathode mount made of a conducting material having much less of an ability to emit electrons than the conducting material of said cathode means during the applied electrical pulse.

7. The apparatus of claim 4 in which said cylindrical cathode means is made of carbon.

8. The apparatus of claim 6 in which said cathode shank means, said anode means, and said anode stalk means are stainless steel.

9. A reflex triode receiving an electrical pulse from a pulse generator for producing an ion beam comprising:

chamber means, made of electrical conducting material permeable to magnetic fields, connected to said pulse generator and enclosing said reflex triode to maintain a vacuum;

cylindrical cathode means, made of a conducting material for emitting electrons;

cylindrically shaped cathode shank means of an electrically conducting material for supporting said cathode means, said cathode shank means positioned inside of said chamber means and being at the same potential as said chamber means;

anode means having a support made up of a conducting material and a thin film of polyethylene supported by said support, said thin film approximately facing and spaced from said cathode means, for providing a plasma as a source of ions and for causing accumulation of reflexing electrons near the anode to provide an enhanced ion flow, said film being supported in such a manner that substantially only the film is placed in the path of reflexing electrons in the triode;

cylindrical anode stalk means shaped cylindrically of a conducting material and positioned inside of and closely spaced from said cathode shank means, said stalk means being approximately equal in axial length to said cathode shank means, one end of said anode stalk means connected to said pulse generator and the other end supporting said anode means;

electromagnet winding means cooperating with said chamber means for providing a uniform magnetic field between said anode stalk means and said cathode shank means to prevent electron emission and electrical current flow between said anode stalk means and said cathode shank means.

* * * * *